US006809463B2

(12) United States Patent
Suzuki

(10) Patent No.: US 6,809,463 B2
(45) Date of Patent: Oct. 26, 2004

(54) SPARK PLUG AND METHOD FOR MANUFACTURING THE SPARK PLUG

(75) Inventor: Akira Suzuki, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 18 days.

(21) Appl. No.: 10/327,109

(22) Filed: Dec. 24, 2002

(65) Prior Publication Data

US 2003/0155850 A1 Aug. 21, 2003

(30) Foreign Application Priority Data

Dec. 28, 2001 (JP) ..... 2001-401406

(51) Int. Cl.[7] ..... H01T 13/20

(52) U.S. Cl. ..... 313/141; 313/118; 313/135; 313/144

(58) Field of Search ..... 313/141, 118, 313/135, 144

(56) References Cited

FOREIGN PATENT DOCUMENTS

| | | |
|---|---|---|
| JP | 63-14858 | 6/1988 |
| JP | 63-266046 | 11/1988 |
| JP | 2-70019 | 3/1990 |

*Primary Examiner*—Vip Patel
(74) *Attorney, Agent, or Firm*—Sughrue Mion, PLLC

(57) ABSTRACT

A spark plug configured such that a metallic shell is joined to an insulator through crimping. The metallic shell is firmly joined to the insulator by means of a sufficient fastening force even when the diameter of the spark plug is reduced, to thereby enhance gastightness and vibration resistance. A method for manufacturing the spark plug is also disclosed.

6 Claims, 6 Drawing Sheets

SPARK PLUG AND METHOD FOR MANUFACTURING THE SPARK PLUG

BACKGROUND OF THE INVENTION

1. Field of the Invention

The present invention relates to a spark plug used for igniting an internal combustion engine.

2. Description of the Related Art

The metallic shell of a spark plug is fixedly attached to an insulator by means of crimping. Specifically, the insulator is inserted into the metallic shell formed into a tubular shape, and then by use of dies a compressive load is applied to the peripheral edge of a rear end portion (a portion to be crimped) of the metallic shell. By this procedure, the portion to be crimped is curved toward a flange-like protrusion formed on the outer circumferential surface of the insulator to thereby become a crimped portion, whereby the insulator is fixed in place. The metallic shell is generally formed from a steel material such as carbon steel.

A method for firmly joining the insulator to the metallic shell by means of the crimped portion is specifically carried out in the following manner. As shown in FIG. 2(*a*), when a portion-to-be-crimped 1*d*' is axially compressed by means of crimping dies 110 and 111, the portion-to-be-crimped 1*d*' is plastically deformed radially inward in a compressed condition. Packings 60 and 62 and a filler material 61 such as talc are usually disposed between the portion-to-be deformed 1*d*' and a flange-like protrusion 2*e* (in some cases, the filler material may be omitted, with only a single thick packing disposed). When compressive deformation of the portion-to-be-crimped 1*d*' increases, a load begins to be imposed on the packings 60 and 62, the filler material 61, and the flange-like protrusion 2*e* (hereinafter, these are generically and collectively called a "portion to be compressed"). While the portion to be compressed undergoes compressive deformation, plastic deformation of the portion-to-be-crimped 1*d*' proceeds further. Then, as shown in FIG. 2(*b*) which is a step following the step shown in FIG. 2(*a*), when a final value for a compression stroke for crimping is reached, unloading is performed to thereby complete the crimping process (the portion-to-be-crimped 1*d*' becomes a crimped portion 1*d*). The unloading induces some springback of the crimped portion 1*d*. However, since the crimped portion 1*d* is plastically deformed, the crimped portion 1*d* retains the compressed portion in an elastically deformed condition, thereby inducing a fastening force for firmly joining the insulator 2 to the metallic shell 1.

3. Problems Solved by the Invention:

Along with a recent tendency of an engine toward complex arrangement around heads and an increase in valve diameter, spark plugs show a marked tendency towards a decrease in diameter and increase in length. However, decreasing the diameter of a spark plug requires employing a metallic shell having a small diameter and a thin wall. As is apparent from the above-described principle, a force for fastening the insulator against the metallic shell is induced by reaction from the crimped portion 1*d*. Since a reduction in the diameter and wall thickness of the metallic shell is accompanied by a reduction in the cross-sectional area of the crimped portion 1*d*, bringing stress arising on the cross section of the crimped portion 1*d* to the same level as a conventional one requires a reduction in compression stroke for crimping. Thus, total fastening force decreases by an extent corresponding to the reduction in the cross-sectional area. As a result, gastightness established between the metallic shell and the insulator is deteriorated. Particularly, when harsh vibrations act on a spark plug as in high-speed, high-load driving, crimping of the spark plug may be loosened, and thus gastightness is more likely to be deteriorated.

By contrast, an attempt to maintain the total fastening force at the same level as a conventional one involves an increase in stress by an extent corresponding to a decrease in the cross-sectional area of the crimped portion 1*d*; as a result, the strength of the crimped portion 1*d* fails to endure the stress, thereby leading to a failure to maintain gastightness.

SUMMARY OF THE INVENTION

An object of the present invention is to enable, in a spark plug configured such that a metallic shell is joined to an insulator through crimping, the metallic shell to be firmly joined to the insulator by means of a sufficient fastening force even when the diameter of the spark plug is reduced, to thereby enhance gastightness and vibration resistance.

The above object of the present invention is achieved by providing a spark plug comprising a rodlike center electrode, a rodlike insulator surrounding the center electrode and having a protrusion at a central portion thereof, a metallic shell assuming an open-ended, tubular shape and surrounding the insulator, and having two protrusions and a thin-walled portion formed on an outer surface thereof at a central portion thereof with respect to the direction of said axis, the thin-walled portion being located between said two protrusions and being thinner than said two protrusions; and a ground electrode facing the center electrode and defining a spark discharge gap in cooperation with the center electrode, and characterized in that:

an insulator insertion hole into which the protrusion of the insulator is inserted is formed in the metallic shell while extending in the direction of an axis (O); when a side toward the spark discharge gap with respect to the direction of the axis is taken as a front side, a rear end portion of the metallic shell is crimped by a cold crimping step toward the insulator to form a curved, crimped portion; and, in order to achieve the above object, the inside diameter of the insulator insertion hole of the metallic shell is 8–12 mm as measured at a position where the inner wall surface of the insulator insertion hole transitions to the inner wall surface of the crimped portion with respect to the direction of the axis of the metallic shell; and the cross-sectional area S of the metallic shell as measured when the metallic shell is cut at the position by a plane perpendicular to the axis, and the carbon content of a steel material used to form the metallic shell satisfy either of the following conditions A and B:

condition A: $15 \leqq S < 29$ mm$^2$ and a carbon content of 0.20%–0.50% by weight; and condition B: $29 \leqq S < 35$ mm$^2$ and a carbon content of 0.15%–0.50% by weight.

When a side toward a spark discharge gap with respect to the direction of the axis is taken as a front side, a tool engagement portion (a so-called hexagonal portion) is usually formed on the metallic shell of the spark plug to be located adjacent to and on the front side of the crimped portion of the metallic shell. When the spark plug is to be mounted into a plug attachment hole formed in an internal combustion engine, a tool such as a wrench is engaged with the tool engagement portion. Conventionally, the tool engagement portion of a spark plug has dominantly employed an opposite side-to-side dimension of 16 mm or more, so that the cross-sectional area of the crimped portion can be 40 $mm^2$ or more. However, the previously mentioned tendency to decrease the diameter of a spark plug is also bringing about increasing demand for reducing the size of the tool engagement portion, for, for example, the following reasons: employment of a direct ignition method-in which individual ignition coils are directly attached to upper portions of corresponding spark plugs-narrows an available space above a cylinder head; and the previously mentioned increase in area occupied by valves forces a reduction in the diameter of plug holes. As a result, the opposite side-to-side dimension of the tool engagement portion is forced to be reduced to, for example, 14 mm or less from a conventionally available dimension of 16 mm or more. Condition A or B of the present invention provides the range of the cross-sectional area of the crimped portion in view of employing a metallic shell whose diameter is reduced such that the opposite side-to-side dimension of the tool engagement portion is not greater than 14 mm, for example. Also, the range of the inside diameter (8–12 mm) of the insulator insertion hole of the metallic shell is determined in view of a reduction in the diameter of the metallic shell. Notably, the inside diameter of the insulator insertion hole of the metallic shell is that measured at a position where the protrusion of the insulator is inserted.

A feature of the present invention is to form the metallic shell whose crimped portion has a cross-sectional area as reduced as mentioned above, from a steel material whose carbon content is increased according to the cross-sectional area, so as to impart to the crimped portion strength capable of sufficiently enduring an increased fastening stress. As a result, the metallic shell can be firmly joined to the insulator by means of a sufficient fastening force, thereby enhancing gastightness and vibration resistance.

Specifically, the outside diameter of the metallic shell is classified into two categories, or condition A and condition B, according to the range of the cross-sectional area S of the crimped portion. Condition A employs the following range of the cross-sectional area S of the crimped portion: $15 \leqq S < 29$ $mm^2$. In this case, the carbon content of a steel material used to form the metallic shell is selected so as to fall within the range of 0.20% by weight to 0.50% by weight. Condition B employs the following range of the cross-sectional area S of the crimped portion: $29 \leqq S < 35$ $mm^2$. In this case, the carbon content of a steel material used to form the metallic shell is selected so as to fall within the range of 0.15% by weight to 0.50% by weight.

In either case, when the carbon content of a steel material falls below the lower limit, the strength of the crimped portion becomes insufficient to endure a fastening stress, thereby leading to lack of gastightness or vibration resistance. By contrast, when the carbon content of a steel material exceeds the upper limit, in the case of a metallic shell to be manufactured by a cold forging (press-forming) process, deformation resistance of the steel material becomes excessively high, thereby leading to a reduction in working efficiency or a reduction in the life of a working tool and thus to an increase in manufacturing cost. This tendency is particularly marked in the case of a metallic shell having a small diameter and a long axial length.

Condition A, which employs a narrower range of the cross-sectional area S of the crimped portion, sets a higher lower limit for the carbon content of a steel material, since greater stress is required than in the case of condition B, in order to secure gas-tightness. Condition A also requires at least 15 $mm^2$ for the cross-sectional area S, since a metallic shell having a small diameter such that the cross-sectional area S of the crimped portion is less than 15 $mm^2$ fails to maintain gastightness. This also applies to the lower limit (8 mm) of the inside diameter of the insulator insertion hole of the metallic shell.

The above-mentioned crimped portion can be formed by means of cold crimping. Cold crimping has an advantage of employing simple crimping equipment and thus having a short cycle time, which is efficient.

Next, an anticorrosive film is formed on most conventional types of metallic shells for spark plug use and formed from a carbon steel or the like. Galvanization, which is inexpensive and excellently anticorrosive, has been employed as a method for forming the anticorrosive film. However, in the case of the metallic shell used in the present invention and formed from a steel material of high carbon content, galvanization raises the following problem.

In electrogalvanization, zinc, which is more basic than iron, must be deposited on the surface of iron; therefore, electric potential for galvanization is set relatively high. As a result, hydrogen tends to be generated in the process of galvanization. The thus-generated hydrogen is absorbed into a base material, or a steel material. However, in the case of a high-strength steel material, the thus absorbed hydrogen is known to tend to cause hydrogen embrittlement; i.e., a high-strength steel material tends to become brittle as a result of absorption of hydrogen. The presence of restraint stress induced from tension is known to play an important role in occurrence of hydrogen embrittlement. The crimped portion of the metallic shell is subjected to tensile stress at all times in order to endure fastening stress and is thus likely to suffer hydrogen embrittlement.

In any case, when crimping is loosened as a result of hydrogen embrittlement, the gastightness and vibration resistance of the metallic shell are impaired. Hydrogen embrittlement fracture is known not to occur immediately upon establishment of embrittlement conditions (i.e., absorption of a certain amount or more of hydrogen and imposition of restraint stress), but to occur after a certain incubation period. Such fracture is also called delayed cracking or delayed fracture.

The spark plug of the present invention uses a steel material whose strength is enhanced through an increase in carbon content, as mentioned above. Since such a steel material is highly susceptible to hydrogen embrittlement, the crimped portion must be designed so as to prevent occurrence of hydrogen embrittlement. The higher the restraint stress, the shorter the incubation period of delayed fracture. Therefore, delayed fracture is more likely to occur in a spark plug which, in order to compensate for a reduction in the cross-sectional area of the crimped portion, employs crimping of a long compression stroke so as to increase fastening stress. When cold crimping is employed, hydrogen embrittlement is likely to occur at a part of the crimped portion where stress concentrates due to work strain, and employing a long compression stroke increases the amount of accumulated work strain.

When galvanization is to be applied to the metallic shell of the spark plug of the present invention, the galvanization conditions must be carefully determined so as to prevent excessive generation of hydrogen in the process of galvanization. However, narrowing galvanization conditions encounters difficulty in controlling the conditions, thereby leading to increased cost.

Thus, preferably, a nickel plating layer is employed in place of conventional galvanization, for use as an anticorrosive film to be formed on the metallic shell. In contrast to zinc, nickel is more noble than iron; thus, nickel can be deposited smoothly without the need to increase electric potential for electrolytic nickel plating. Therefore, nickel plating, by nature, is unlikely to involve generation of hydrogen and thus unlikely to raise a hydrogen embrittlement problem.

In the claims appended hereto, reference numerals assigned to elements are cited from the accompanying drawings for providing fuller understanding of the nature of the present invention, but should not be construed as limiting the invention.

Figure 1:
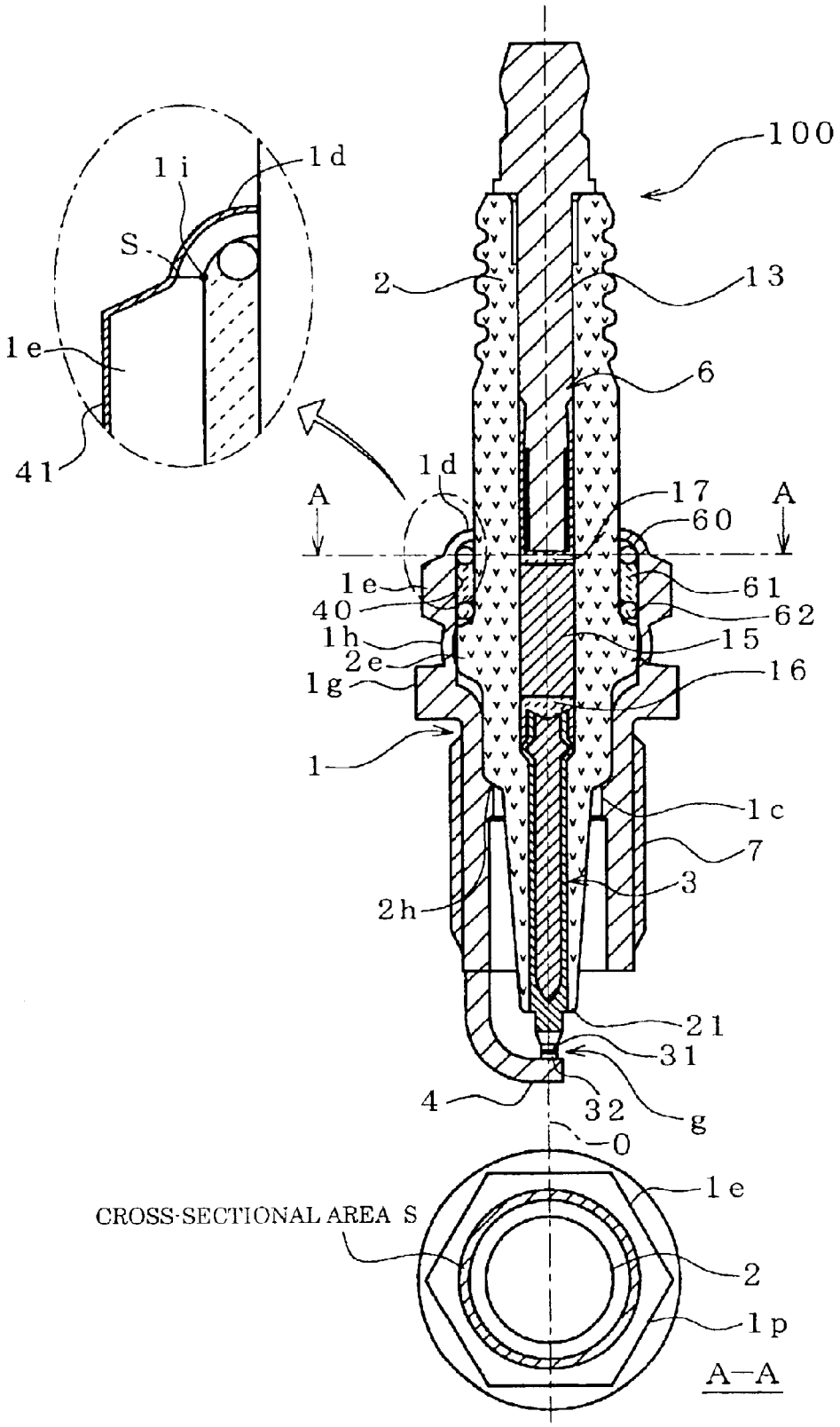
FIG. 1 shows views illustrating a spark plug according to a first embodiment of the present invention by use of various cross sections.

Description of Reference Numerals:

100, 200, 300, 400: spark plugs
1: metallic shell
1*d*: crimped portion
1*e*: tool engagement portion
1*h*: thin-walled portion
2: insulator
3: center electrode
4: ground electrode
g: spark discharge gap
7: male-threaded portion
40: insulator insertion hole

DETAILED DESCRIPTION OF THE INVENTION

Modes for carrying out the present invention will next be described by way of embodiments illustrated in the accompanying drawings, which embodiments should not be construed as limiting the invention.

FIG. 1 shows a spark plug 100 according to an embodiment of the present invention. The spark plug 100 includes a tubular metallic shell 1; an insulator 2 fitted into the metallic shell 1 such that a front end portion 21 projects from the metallic shell 1; a center electrode 3 provided in the insulator 2 such that a noble-metal discharge portion 31 formed on its front end projects from the insulator 2; and a ground electrode 4, one end thereof being joined to the metallic shell 1 by means of welding or the like, the other end portion thereof being bent such that its side surface faces the discharge portion 31 of the center electrode 3. A noble-metal discharge portion 32 is formed on the ground electrode 4 in opposition to the noble-metal discharge portion 31. The noble-metal discharge portion 31 and the noble-metal discharge portion 32 form a spark discharge gap g therebetween.

The insulator 2 is formed from a ceramic sintered body such as alumina or aluminum nitride. The insulator 2 has a through-hole 6 formed therein along its axial direction so as to receive the center electrode 3. A metallic terminal member 13 is fixedly inserted into one end portion of the through-hole 6, whereas the center electrode 3 is fixedly inserted into the other end portion of the through-hole 6. A resistor 15 is disposed within the through-hole 6 between the metallic terminal member 13 and the center electrode 3. Opposite end portions of the resistor 15 are electrically connected to the center electrode 3 and the metallic terminal member 13 via conductive glass seal layers 16 and 17, respectively. A flange-like protrusion 2*e* is formed at a central portion of the insulator 2.

The metallic shell 1 is formed into a cylindrical shape from carbon steel and serves as a housing of the spark plug 100. A male-threaded portion 7 and two protrusions (the tool engagement portion 1*e* and the gas seal portion 1*g*) are formed on the outer circumferential surface of the metallic shell 1 and adapted to mount the spark plug 100 on an unillustrated engine block. When a side toward the spark discharge gap g with respect to the direction of the axis O is taken as the front side, a flange-like gas seal portion 1*g* is formed adjacent to the rear side of the male-threaded portion 7, and a tool engagement portion 1*e* with which a tool such as a spanner or wrench is engaged when the metallic shell 1 is to be mounted is formed on the rear side relative to the gas seal portion 1*g*. A thin-walled portion 1*h* is formed between the tool engagement portion 1*e* and the gas seal portion 1*g*. The wall of the thin-walled portion 1*h* is thinner than that of the tool engagement portion 1*e* and that of the gas seal portion 1*g*.

The tool engagement portion 1*e* has a plurality of pairs of mutually parallel tool engagement faces 1*p* extending in parallel with the axis O and arranged circumferentially. When the tool engagement portion 1*e* is to assume a regular hexagonal cross section, the tool engagement portion 1*e* has three pairs of the tool engagement faces 1*p*. Alternatively, the tool engagement portion 1*e* may have 12 pairs of the mutually parallel tool engagement faces 1*p*. In this case, the cross section of the tool engagement portion 1*e* assumes a shape obtained by shifting two superposed regular hexagonal shapes about the axis O by 30°. In either case, when the opposite side-to-side dimension Σ of the tool engagement portion 1*e* is represented by the distance between opposite sides of the hexagonal cross section, the opposite side-to-side dimension Σ of the tool engagement portion 1*e* is not greater than 14 mm.

An insulator insertion hole 40 of a metallic shell 1 into which the flange-like protrusion 2*e* of the insulator is inserted has an inside diameter of 8–12 mm. A steel material is selected such that, when S represents the cross-sectional area of the metallic shell 1 (the cross-sectional area of the crimped portion) as measured on a plane (A—A) perpendicularly intersecting the axis O at a position 1*i* where the inner wall surface of the insulator insertion hole 40 transitions to the inner wall surface of the crimped portion 1*d* with respect to the direction of the axis O of the metallic shell 1, the cross-sectional area S of the crimped portion and the carbon content of a steel material used to form the metallic shell 1 satisfy either of the following conditions A and B:

condition A: $15 \leqq S < 29$ mm$^2$ and a carbon content of 0.20%–0.50% by weight; and condition B: $29 \leqq S < 35$ mm$^2$ and a carbon content of 0.15%–0.50% by weight.

A ringlike thread packing 62—which abuts a rear end edge portion of the flange-like protrusion 2*e*—is disposed between the inner surface of a rear opening portion of the metallic shell 1 and the outer surface of the insulator 2, and a ringlike packing 60 is disposed on the rear side relative to the packing 62 while a filler layer 61 such as talc is interposed between the packings 60 and 62. The insulator 2 is pressed toward the front side while being inserted in the metallic shell 1, and then the opening edge of the metallic shell 1 is crimped inward toward the packing 60 to thereby form the crimped portion 1*d*, whereby the metallic shell 1 is firmly joined to the insulator 2. Notably, an unillustrated gasket is fitted to a rear end part of the male-threaded portion 7 of the metallic shell 1 so as to abut the front end face of the gas seal portion 1*g*.

The entire outer surface of the metallic shell 1 is covered with a nickel plating layer 41 for anticorrosiveness. The nickel plating layer 41 is formed by a known electroplating process and has a thickness of, for example, about 3–15 μm (as measured on a tool engagement face of the tool engagement portion 1*e*). When the film thickness is less than 3 μm, sufficient anticorrosiveness may not be attained. By contrast, a film thickness in excess of 15 μm is unnecessarily thick in terms of attainment of anticorrosiveness and requires a long plating time, thereby leading to an increase in cost. Additionally, when the insulator 2 is to be joined by a crimping process, which will be described later, plating is likely to exfoliate at a portion subjected to crimping deformation.

A method for manufacturing the above-described spark plug 100 according to the present invention will next be described. First, the nickel plating layer 41 is formed on the metallic shell 1 by a known electroplating process. The insulator 2 having the center electrode 3, the conductive glass seal layers 16 and 17, the resistor 15, and the metallic terminal member 13 inserted into the through-hole 6 is inserted into the metallic shell 1 from an opening portion located on the rear side of the insulator insertion hole 40 until an engagement portion 2*h* of the insulator 2 and an engagement portion 1*c* of the metallic shell 1 are joined via a thread packing (not shown) (see FIG. 1 for these members). Next, the thread packing 62 is inserted into the metallic shell 1 from the insertion opening portion and disposed in place; a filler is placed into the metallic shell 1; and the thread packing 60 is disposed in place. Subsequently, a portion to be crimped of the metallic shell 1 is crimped toward the insulator 2 via the thread packings 60 and 62 and the filler, thereby forming the filler layer 61 and joining the metallic shell 1 and the insulator 2. In the present embodiment, this crimping process employs cold crimping.

Figure 2A:
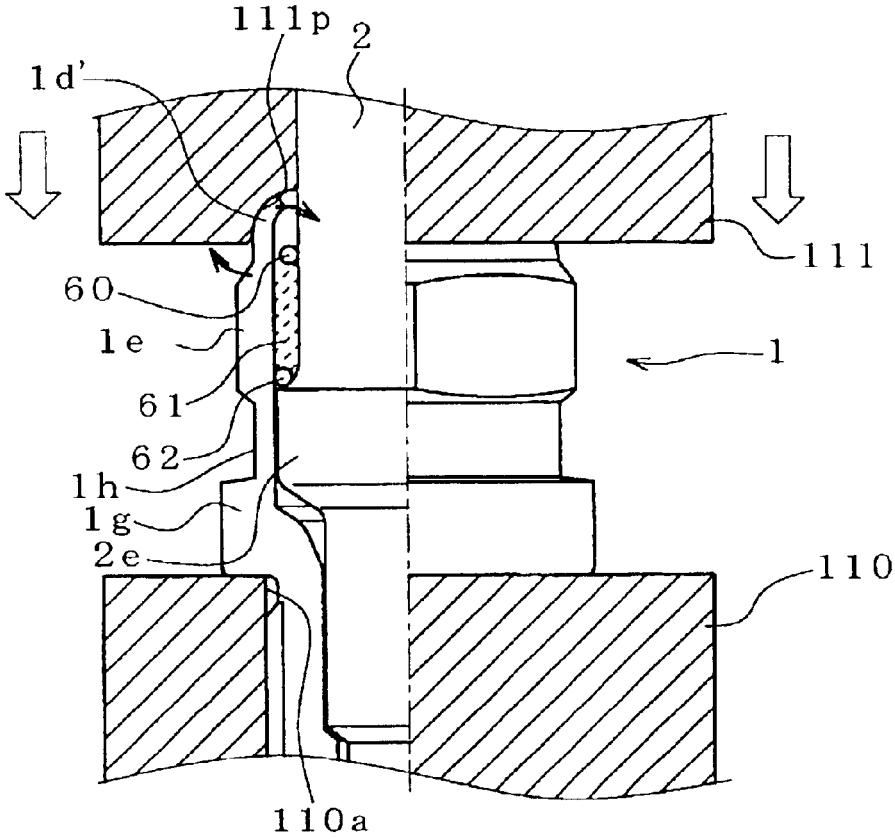
FIGS. 2(*a*) and 2(*b*) are views illustrating a crimping process.
Figure 2B:
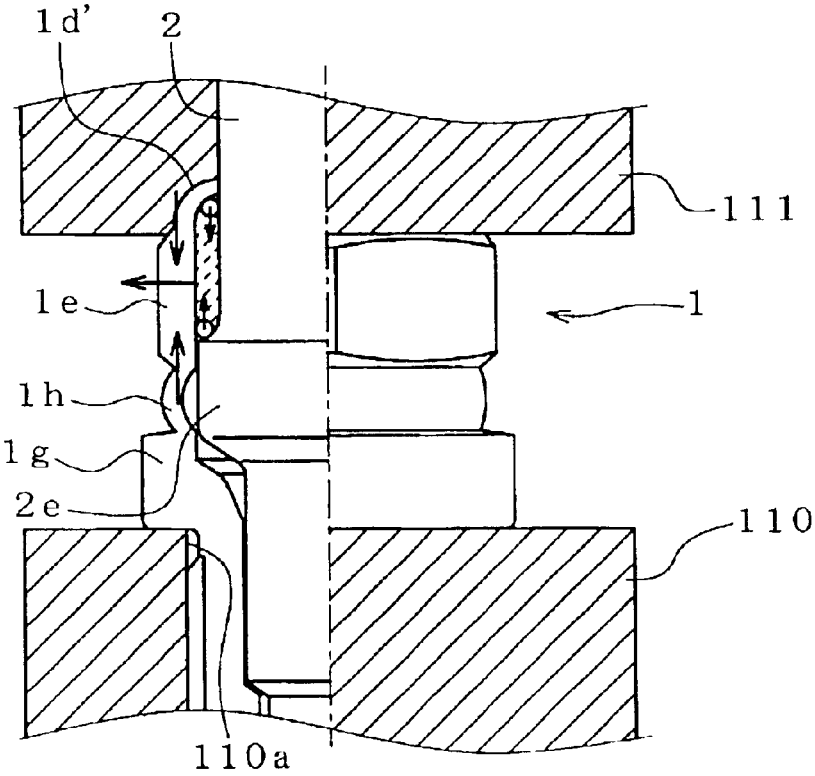

The above-mentioned crimping process can be specifically performed as shown in FIG. 2. First, as shown in a first step in FIG. 2(*a*), a front end portion of the metallic shell 1 is inserted into a setting hole 110*a* of a crimping base 110 such that the flange-like gas seal portion 1*g* formed on the metallic shell 1 resets on the opening periphery of the setting hole 110*a*. Notably, the crimped portion 1*d* of the metallic shell 1 in FIG. 1 assumes a cylindrical form before crimping, and the cylindrical portion is called a portion-to-be-crimped 1*d*'. Next, the crimping die 111 is fitted to the metallic shell 1 from above. A concave crimping action surface 111*p* corresponding to the crimped portion 1*d* (FIG. 1) is formed on a portion of the crimping die 111 which abuts the portion-to-be-crimped 1*d*'. In this state, when an axial compressive force directed toward the crimping base 110 is applied to the crimping die 111 so as to move the crimping die 111 toward the crimping base 110, the portion-to-be-crimped 1*d*' is compressed while being curved radially inward along the crimping action surface 111*p*. As shown in a second step in FIG. 2(*b*), the metallic shell 1 and the insulator 2 are firmly joined through crimping. As a result of applying the compressive force, the thin-walled portion 1*h* formed between the gas seal portion 1*g* and the tool engagement portion 1*e* is flexibly deformed in the radially outward direction so as to contribute toward increasing the stroke of compression of the filler layer 61 in the process of crimping, thereby enhancing sealing performance.

EXAMPLES

Next will be described the results of experiments conducted for confirming the effect of the present invention. However, the present invention shall not be construed as being limited thereto.

Example 1

Figure 3:
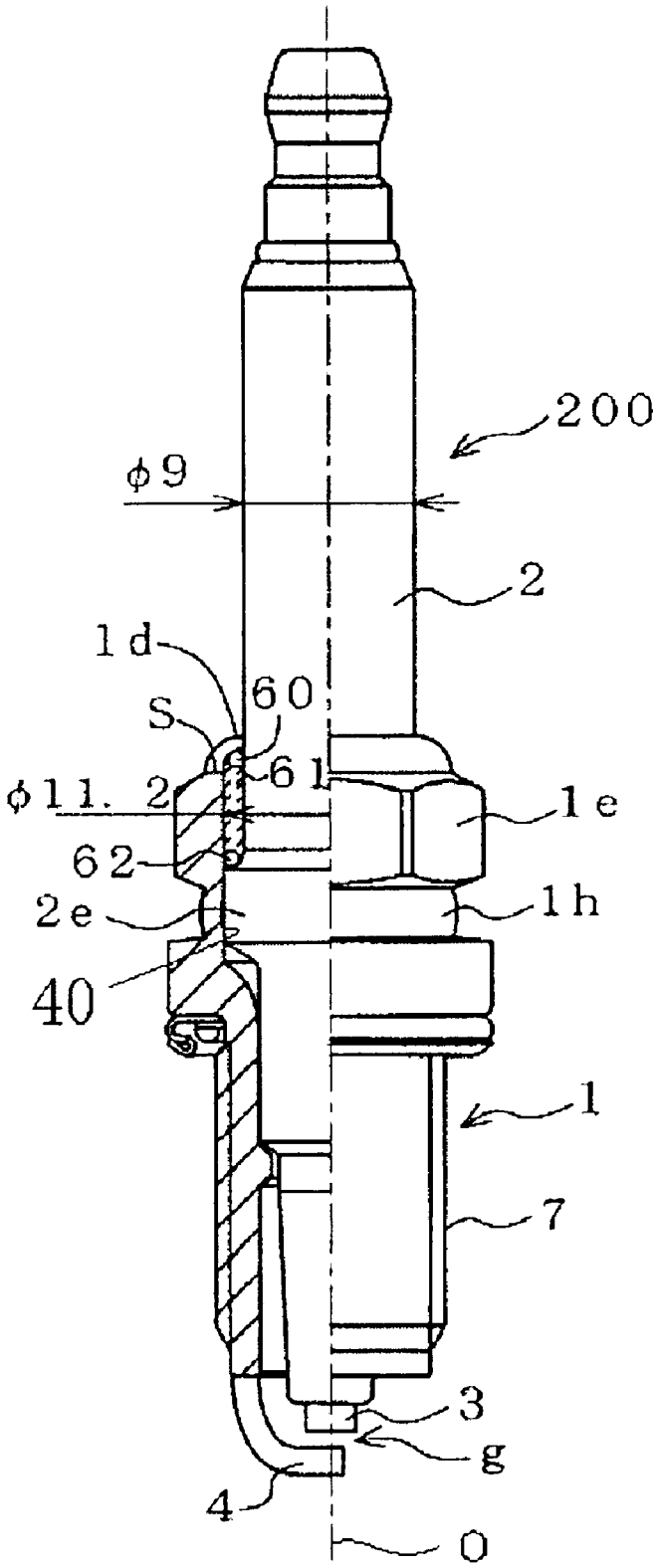
FIG. 3 is a longitudinal, partially sectional view showing a first spark plug according to the first embodiment.
Figure 4:
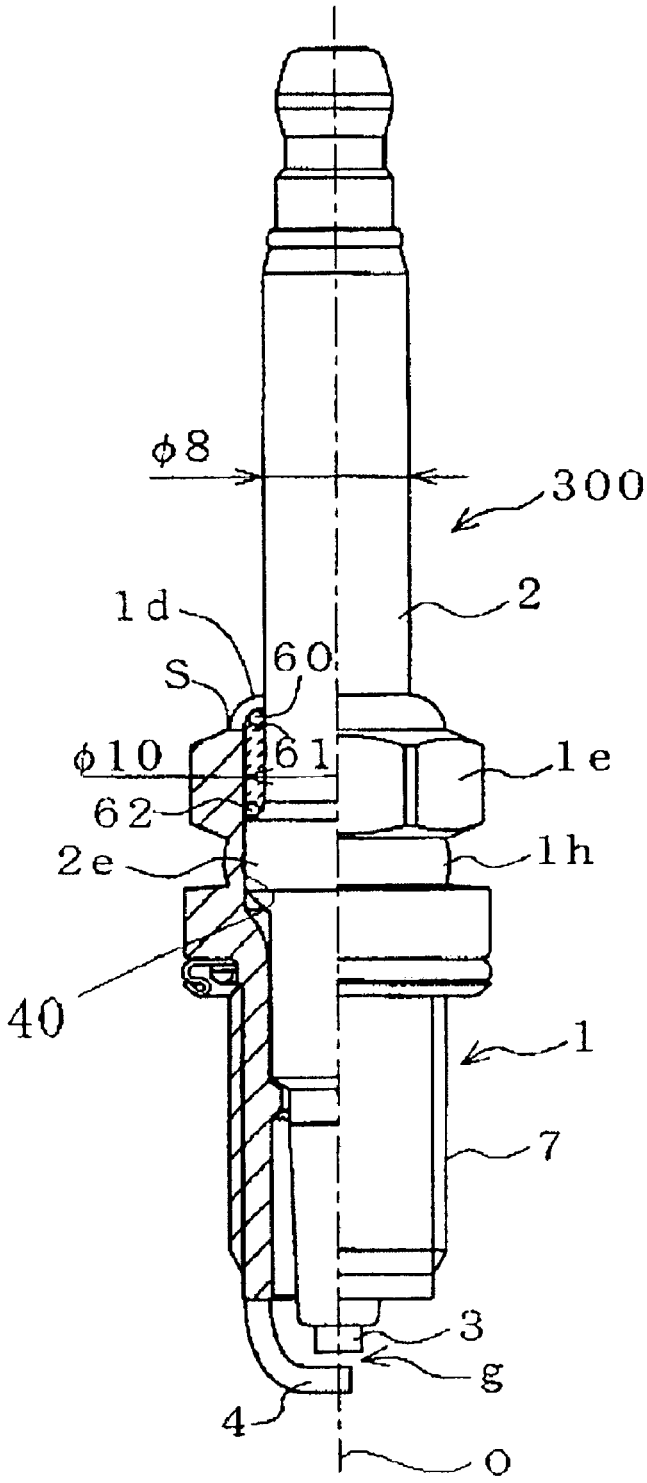
FIG. 4 is a longitudinal, partially sectional view showing a second spark plug according to the first embodiment.

Spark plugs 200 and 300 shown in FIGS. 3 and 4 were fabricated for test use. These spark plugs 200 and 300 are configured in a manner similar to that of the spark plug 100 of FIG. 1 except that the noble-metal discharge portions 31 and 32 are omitted. Structural features conceptually common to those of the spark plug 100 of FIG. 1 are denoted by common reference numerals (typical structural features are selected and assigned reference numerals). The crimped portion 1*d* is formed by means of cold crimping.

The spark plugs 200 and 300 have the following features:

Spark plug 200 (FIG. 3)

Cross-sectional area S of crimped portion: 29–35 $mm^2$;

Inside diameter of insulator insertion hole 40: 11.2 mm; and

Cold crimping condition: applied pressure 3–4 ton.

Spark plug 300 (FIG. 4)

Cross-sectional area S of crimped portion: 13–29 $mm^2$;

Inside diameter of insulator insertion hole 40: 10 mm; and

Cold crimping condition: applied pressure 2–3 ton.

In the spark plugs 200 and 300, the carbon content of the carbon steel used to form the metallic shell 1 was varied in the range of 0.05% by weight to 0.50% by weight. These spark plugs 200 and 300 were subjected to a hot airtightness test under the conditions below and measured for air leakage from the crimped portion 1*d* (portion filled with the filler material 61).

(Test Conditions)

Ambient temperature: 200° C.

Vibrating conditions: as described in ISO15565

Vibration frequency: 50–500 Hz

Sweep rate: 1 octave/minute

Acceleration: 30 GN

Vibrating direction: perpendicular to axis O of spark plug

Vibrating time: 16 hours (Measurement Conditions)

Air pressure: 2 Mpa

Test temperature: 150° C.

Under the above conditions, the measurement criteria were as follows: good (O): no air leakage; acceptable (Δ): leakage less than 10 cc; and not acceptable (x) leakage not less than 10 cc. Table 1 shows the test results of the spark plugs 200 and 300. Table 1 shows the results of the individual spark plugs 200 and 300 while the test quantity n is 3.

TABLE 1

| Carbon content (by weight %) | 0.05 | 0.10 | 0.15 | 0.20 | 0.30 | 0.40 | 0.50 | types |
|---|---|---|---|---|---|---|---|---|
| Cross-sectional Area/S(mm$^1$) | | | | | | | | |
| 13 | X, X, X | X, X, X | X, X, X | Δ, X, X | Δ, X, X | Δ, Δ, X | Δ, Δ, X | 300 |
| 15 | X, X, X | X, X, X | Δ, X, X | Δ, Δ, Δ | Δ, Δ, Δ | Δ, Δ, Δ | ○, Δ, Δ | |
| 17 | X, X, X | X, X, X | Δ, X, X | Δ, Δ, Δ | ○, Δ, Δ | ○, Δ, Δ | ○, ○, Δ | |
| 19 | X, X, X | X, X, X | Δ, X, X | Δ, Δ, Δ | ○, ○, Δ | ○, ○, Δ | ○, ○, ○ | |
| 21 | X, X, X | X, X, X | Δ, Δ, X | ○, Δ, Δ | ○, ○, Δ | ○, ○, ○ | ○, ○, ○ | |
| 23 | X, X, X | Δ, X, X | Δ, Δ, X | ○, Δ, Δ | ○, ○, ○ | ○, ○, ○ | ○, ○, ○ | |
| 25 | X, X, X | Δ, X, X | Δ, Δ, X | ○, ○, Δ | ○, ○, ○ | ○, ○, ○ | ○, ○, ○ | |
| 27 | X, X, X | Δ, X, X | Δ, Δ, X | ○, ○, Δ | ○, ○, ○ | ○, ○, ○ | ○, ○, ○ | |
| 29 | X, X, X | Δ, X, X | Δ, Δ, Δ | ○, ○, Δ | ○, ○, ○ | ○, ○, ○ | ○, ○, ○ | |
| 29 | X, X, X | Δ, X, X | Δ, Δ, Δ | ○, ○, Δ | ○, ○, ○ | ○, ○, ○ | ○, ○, ○ | 200 |
| 31 | X, X, X | Δ, X, X | ○, Δ, Δ | ○, ○, Δ | ○, ○, ○ | ○, ○, ○ | ○, ○, ○ | |
| 33 | X, X, X | Δ, Δ, X | ○, Δ, Δ | ○, ○, Δ | ○, ○, ○ | ○, ○, ○ | ○, ○, ○ | |
| 35 | X, X, X | Δ, Δ, X | ○, ○, Δ | ○, ○, ○ | ○, ○, ○ | ○, ○, ○ | ○, ○, ○ | |

As is apparent from the above test results, the spark plugs 200 which satisfy the carbon content range of condition B and the spark pugs 300 which satisfy the carbon content range of condition A exhibited no air leakage at 150° C., thereby indicating that gastightness has maintained.

Example 2

Figure 5:
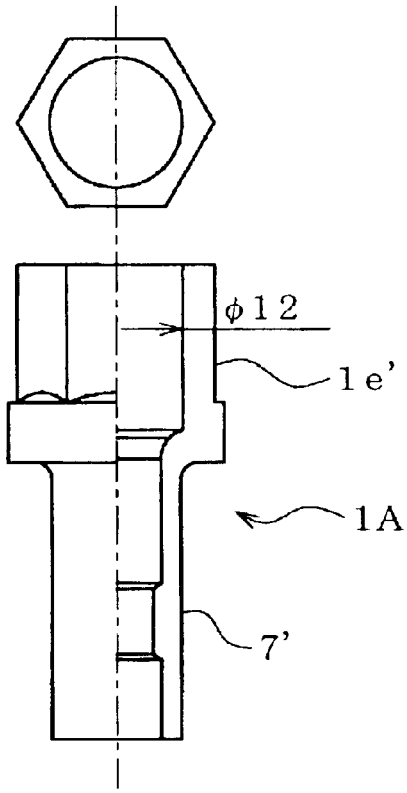
FIG. 5 is a longitudinal, half sectional view showing a first metallic shell used in a second embodiment.
Figure 6:
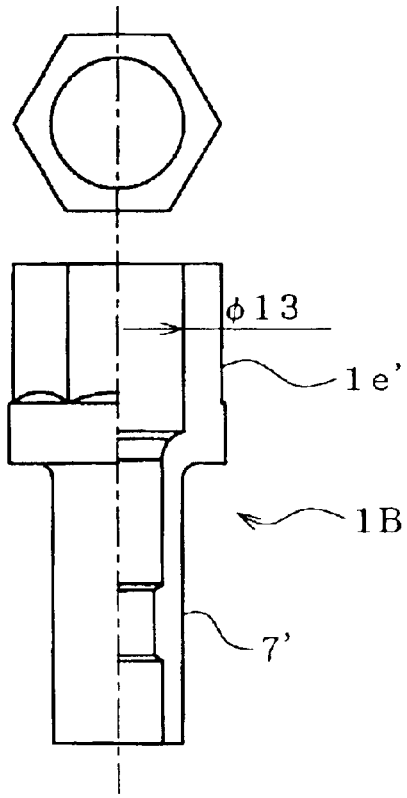
FIG. 6 is a longitudinal, half sectional view showing a second metallic shell used in the second embodiment.

In order to study the relationship between the cold press-forming formability of the metallic shell and the inside diameter of the insulator insertion hole, metallic shells 1A and 1B as shown in FIGS. 5 and 6 were formed from various carbon steels of different carbon contents ranging from 0.1% by weight to 0.55% by weight by means of cold press-forming. In the thus-formed metallic shells 1A and 1B, a portion 1*e*', which will become the tool engagement portion, has a wall thickness of 1.35 mm; a portion 7', which will become the male-threaded portion, has a wall thickness of 1.75 mm; and the overall length of the metallic shells 1A and 1B is 43 mm. A known cold forging process using dies was carried out as the cold press-forming process. The measurement criteria were as follows: forgeable (O): no forming defect such as dent or sink arose; and unforgeable (x): a forming defect arose. The test results are shown in Table 2.

TABLE 2

| Carbon content (% by weight) | 0.1 | 0.2 | 0.3 | 0.4 | 0.45 | 0.50 | 0.55 |
|---|---|---|---|---|---|---|---|
| Metallic member 1A | ○ | ○ | ○ | ○ | ○ | ○ | X |
| Metallic member 1B | ○ | ○ | ○ | ○ | ○ | ○ | ○ |

○: The metallic member can be formed by press-forming.
X: The metallic member cannot be formed by press-forming.

As is apparent from the above test results, when the carbon content exceeds 0.5% by weight, forming of the metallic shell 1A, which is 12 mm or less in the inside diameter of the insulator insertion hole, is difficult.

Example 3

Figure 7:
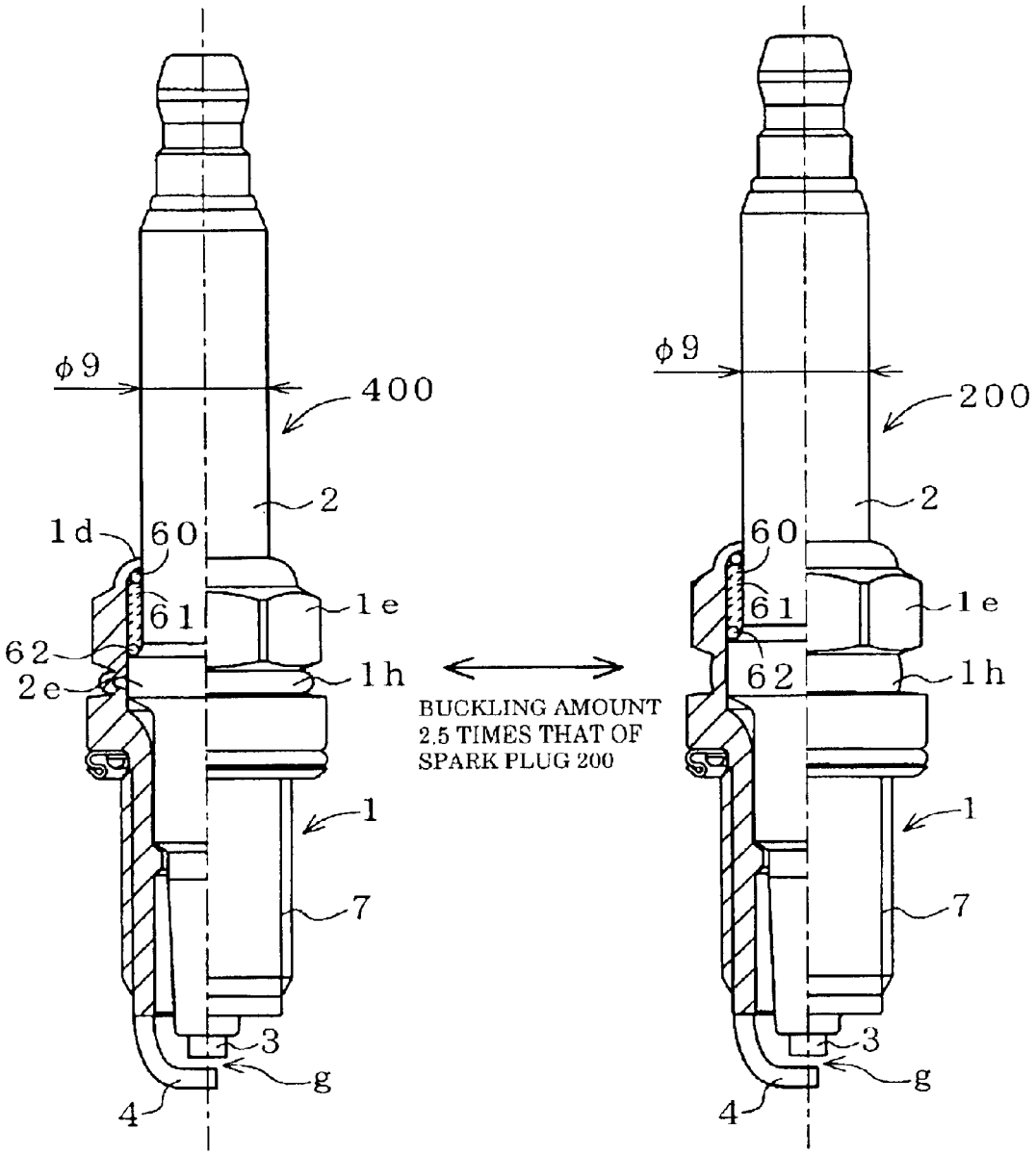
FIG. 7 shows longitudinal, partially sectional views comparing a spark plug according to a third embodiment with the first spark plug of the first embodiment.

Various carbon steels of different carbon contents ranging from 0.05% by weight to 0.50% by weight were selected so as to form metallic shells therefrom. 20,000 metallic shells, each of which is identical to that of the spark plug 200 shown in FIG. 3, were manufactured from each of the selected carbon steels. An anticorrosive film was formed on the 20,000 metallic shells in the following manner: an electrolytic nickel plating layer having a thickness of 5 μm was formed on 10,000 metallic shells, and an electrogalvanization layer having a thickness of 5 μm was formed on the remaining 10,000 metallic shells. By use of the metallic shells, spark plugs 400 were manufactured in the following manner: the metallic shells were subjected to cold crimping of such an excessive compression stroke that, as shown in FIG. 7, the amount of buckling deformation of the thin-walled portion 1*h* was 2.5 times that of FIG. 3. The spark plugs 400 were allowed to stand for 48 hours at room temperature and then visually observed for the appearance of the metallic shells. The number of the spark plugs 400 in which hair cracking induced from delayed fracture was observed in the crimped portion 1*d* or thin-walled portion 1*h* was recorded. The results are shown in Table 3.

TABLE 3

| Carbon content | Electrolytic nickel plating Quantity suffering delayed fracture | Electrogalvanization Quantity suffering delayed fracture |
|---|---|---|
| 0.05 | 0 | 0 |
| 0.1 | 0 | 0 |
| 0.15 | 0 | 2 |
| 0.20 | 0 | 4 |
| 0.30 | 0 | 7 |
| 0.40 | 0 | 10 |
| 0.50 | 0 | 15 |

This is an accelerated test which was conducted under far severer crimping conditions. As is apparent from the test results, when a steel material having a carbon content not less than 0.15% by weight is used, the use of a nickel plating layer as an anticorrosive film apparently reduces susceptibility to hydrogen embrittlement as compared with use of a galvanization layer.

It should further be apparent to those skilled in the art that various changes in form and detail of the invention as shown and described above may be made. It is intended that such changes be included within the spirit and scope of the claims appended hereto.

This application is based on Japanese Patent Appln. No. 2001-401406 filed Dec. 28, 2001, the disclosure of which is incorporated herein by reference in its entirety.

What is claimed is:

1. A spark plug comprising a rodlike center electrode (3), a rodlike insulator (2) surrounding said center electrode (3) and having a protrusion (2*e*) at a central portion thereof, a metallic shell (1) assuming an open-ended, tubular shape and surrounding said insulator (2), and a ground electrode (4) facing said center electrode (3) and defining a spark discharge gap (g) in cooperation with said center electrode (3), and characterized in that:

an insulator insertion hole (4) into which said protrusion (2*e*) of said insulator (2) is inserted is formed in said metallic shell (1) while extending in a direction of an axis (O); when a side toward said spark discharge gap (g) with respect to the direction of said axis (O) is taken as a front side, a rear end portion of said metallic shell (1) is cold-crimped toward said insulator (2) to thereby form a curved, crimped portion (1*d*);

two protrusions (1*e* and 1*g*) and a thin-walled portion (1*h*) are formed on an outer surface of said metallic shell (1) such that said thin-walled portion (1*h*) is located between said two protrusions (1*e* and 1*g*), the thin-walled portion (1*h*) is thinner than said two protrusions (1*e* and 1*g*), and assumes an outwardly deflected section and such that one of said protrusions (1*e* and 1*g*) is formed to be located adjacent to and on the front side of said crimped portion (1*d*); and an inside diameter of said insulator insertion hole (40) of said metallic shell (1) is 8–12 mm as measured at a position (1*i*) where an inner wall surface of said insulator insertion hole (40) transitions to an inner wall surface of said crimped portion (1*d*) with respect to the direction of said axis (O) of said metallic shell (1); and a cross-sectional area S of said metallic shell (1) as measured when said metallic shell (1) is cut at said position (1*i*) by a plane perpendicular to said axis (O), and a carbon content of a steel material used to form said metallic shell (1) satisfy either of the following conditions A and B:

condition A: $15 \leqq S < 29$ mm$^2$ and a carbon content of 0.20%–0.50% by weight; and condition B: $29 \leqq S < 35$ mm$^2$ and a carbon content of 0.15%–0.50% by weight.

2. The spark plug as claimed in claim 1, comprising a nickel plating layer formed on said metallic shell (1) so as to serve as an anticorrosive film.

3. A method for manufacturing a spark plug comprising:

a rodlike center electrode (3);

a rodlike insulator (2) having a through-hole (6) formed therein along a direction of an axis (O) and having a protrusion (2*e*) at a central portion thereof, said center electrode (3) being disposed in said through-hole (6);

a metallic shell (1) surrounding said insulator (2), having an insulator insertion hole (40) formed therein so as to accommodate said protrusion (2*e*) of said insulator (2), assuming an open-ended, tubular shape, and having two protrusions (1*e* and 1*g*) and a thin-walled portion (1*h*) formed on an outer surface thereof at a central portion thereof with respect to the direction of said axis (O), the thin-walled portion (1*h*) being located between said two protrusions (1*e* and 1*g*) and being thinner than said two protrusions (1*e* and 1*g*); and a ground electrode (4), a first end of said ground electrode (4) being joined to said metallic shell (1) and a second end of said ground electrode (4) facing said center electrode (3) to thereby define a spark discharge gap (g);

with a side toward said spark discharge gap (g) with respect to the direction of said axis (O) being taken as a front side, a rear end portion of said metallic shell (1) adjacent to one of said two protrusions (1*e* and 1*g*) being crimped toward said insulator (2) to thereby form a curved, crimped portion (1*d*);

said method comprising:

forming said metallic shell (1) such that an inside diameter of said insulator insertion hole (40) of said metallic shell (1) formed from a steel material having a carbon content of 0.20%–0.50% by weight is 8–12 mm as measured at a position (1*i*) where an inner wall surface of said insulator insertion hole (40) transitions to an inner wall surface of said crimped portion (1*d*) with respect to the direction of said axis (O) of said metallic shell (1), and a cross-sectional area S of said metallic shell (1) as measured when said metallic shell (1) is cut at said position (1*i*) by a plane perpendicular to said axis (O) satisfies $15 \leqq S < 29$ mm$^2$;

disposing said insulator (2) in said insulator insertion hole (40) of said metallic shell (1); and cold crimping so as to curve radially inward a portion-to-be-crimped (1*d*') located at a rear end portion of said metallic shell (1), to form said crimped portion (1*d*).

4. A method for manufacturing a spark plug comprising:

a rodlike center electrode (3);

a rodlike insulator (2) having a through-hole (6) formed therein along a direction of an axis (O) and having a protrusion (2*e*) at a central portion thereof, said center electrode (3) being disposed in said through-hole (6);

a metallic shell (1) surrounding said insulator (2), having an insulator insertion hole (40) formed therein so as to accommodate said protrusion (2*e*) of said insulator (2), assuming an open-ended, tubular shape, and having two protrusions (1*e* and 1*g*) and a thin-walled portion (1*h*) formed on an outer surface thereof at a central portion thereof with respect to the direction of said axis (O), said thin-walled portion (1*h*) being located between said two protrusions (1*e* and 1*g*), being thinner than said two protrusions (1*e* and 1*g*), and assuming an outwardly deflected section; and a ground electrode (4), a first end of said ground electrode (4) being joined to said metallic shell (1) and a second end of said ground electrode (4) facing said center electrode (3) to thereby define a spark discharge gap (g);

with a side toward said spark discharge gap (g) with respect to the direction of said axis (O) being taken as a front side, a rear end portion of said metallic shell (1) adjacent to one of said two protrusions (1*e* and 1*g*) being crimped toward said insulator (2) to thereby form a curved, crimped portion (1*d*);

said method comprising:

forming said metallic shell (1) such that an inside diameter of said insulator insertion hole (40) of said metallic shell (1) formed from a steel material having a carbon content of 0.15%–0.50% by weight is 8–12 mm as measured at a position (1*i*) where an inner wall surface of said insulator insertion hole (40) transitions to an inner wall surface of said crimped portion (1*d*) with respect to the direction of said axis (O) of said metallic shell (1), and a cross-sectional area S of said metallic shell (1) as measured when said metallic shell (1) is cut at said position (1*i*) by a plane perpendicular to said axis (O) satisfies $29 \leqq S < 35$ mm$^2$;

disposing said insulator (2) in said insulator insertion hole (40) of said metallic shell (1); and cold crimping so as to curve radially inward a portion-to-be-crimped (1*d*') located at a rear end portion of said metallic shell (1), to form said crimped portion (1*d*).

5. The method for manufacturing a spark plug as claimed in claim 3, which further comprises forming a nickel plating layer on the outer surface of said metallic shell (1), said step intervening between said metallic-shell forming step and said insulator disposing step.

6. The method for manufacturing a spark plug as claimed in claim 4, which further comprises forming a nickel plating layer on the outer surface of said metallic shell (1), said step intervening between said metallic-shell forming step and said insulator disposing step.

* * * * *